United States Patent [19]

Kasai et al.

[11] Patent Number: 4,499,340

[45] Date of Patent: Feb. 12, 1985

[54] SPEAKER FOR AUTOMOTIVE AUDIO SYSTEM WITH VEHICLE PANEL UTILIZED AS SOUND AMPLIFYING MEDIUM

[75] Inventors: Junichi Kasai; Takayuki Yanagishima, both of Yokosuka; Akio Ajimine, Tokyo; Yoshiaki Murakami, Tokyo; Akimitsu Shino, Tokyo; Tatsuya Watanabe, Tokyo, all of Japan

[73] Assignees: Nissan Motor Company, Limited, Yokohama; Clarion Co., Ltd., Tokyo, both of Japan

[21] Appl. No.: 491,293

[22] Filed: May 3, 1983

[30] Foreign Application Priority Data

May 11, 1982 [JP] Japan ..... 57-78635

[51] Int. Cl.[3] ..... H04R 9/02; H04R 9/06

[52] U.S. Cl. ..... 179/115.5 DV; 381/86

[58] Field of Search ..... 179/146 E, 115.5 PS, 179/115.5 DV, 115.5 R; 381/86, 117, 90, 24, 99, 100, 120

[56] References Cited

U.S. PATENT DOCUMENTS 4,300,022 11/1981 Hastings-James et al. ..... 179/115.5 DV

OTHER PUBLICATIONS

Tremaine, *Audio Cyclopedia,* 1979, p. 1125.

*Primary Examiner*—Stafford D. Schreyer
*Assistant Examiner*—James L. Dwyer
*Attorney, Agent, or Firm*—Lane, Aitken & Kananen

[57] ABSTRACT

The driver of a speaker for an automotive audio system includes a plurality of magnetic coils wound around a common bobbin. Each of the magnetic coils is connected to one of a plurality of amplifiers each of which output an identical drive signal. By applying the common drive signal to each magnetic coil, the electromagnetic field created around the magnetic coil is enhanced approximately in proportion to the number of magnetic coils. Due to this increased electromagnetic force, a vehicle panel serving as a sound-amplifying medium can be satisfactorily and successfully driven so as to produce high-quality sound. The amplifiers are adapted to amplify the low-frequency components of the audio signal from a main amplifier.

8 Claims, 3 Drawing Figures

SPEAKER FOR AUTOMOTIVE AUDIO SYSTEM WITH VEHICLE PANEL UTILIZED AS SOUND AMPLIFYING MEDIUM

BACKGROUND OF THE INVENTION

The present invention relates generally to a speaker for an automotive audio system utilizing a vehicle panel, such as a rear parcel shelf, a door inner panel and so forth, as a sound amplifying medium. More particularly, the invention relates to a panel speaker having linear sound reproduction characteristics with respect to the audio frequency and capable of reproducing audio sound at a sufficient output level.

There are some speakers utilizing vehicle panels as sound amplifying mediums. The vehicle panel is driven by a driver of a speaker at the frequency and amplitude of an audio signal by means of a per se well-known audio system such as a radio tuner and/or a tape player. Such speakers are especially adapted to reproduce relatively low-frequency audio signals.

As is well known, automotive audio systems are driven by vehicle batteries having a limited output voltage. In audio systems having a speaker utilizing a vehicle panel as the sound-amplifying medium, good sound quality can be expected since the vibrating area of the vehicle panel serving as the sound-amplifying medium is adequately large. On the other hand, since the vehicle panel serving as the sound-amplifying medium will tend to be heavier than normal sepaker cones, such speakers require high driving power in order to reproduce audio signals with sufficient quality and amplitude. The vehicle battery lacks the capacity of output voltage required to drive the such a vehicle panel sound-amplifying medium. For example, in case of a 12 V vehicle battery, the capacity of the amplifier satisfactorily driven by the vehicle battery may be about 5 W for a normal amplifier and 20 W for a BLT-type amplifier. These amplifier output levels are not enough to satisfactorily and successfully drive the vehicle panel sound-amplifying medium. To resolve this problem, it is possible to provide a transformer to boost the output voltage of the vehicle battery so as to allow use of a larger-capacity amplifier. However, providing such a transformer would necessarily increase the cost of the audio system.

SUMMARY OF THE INVENTION

Therefore, it is an object of the present invention to provide an inexpensive speaker for an automotive audio system which is applicable to an audio system of conventional capacity.

More specifically, the object of the invention is to provide a speaker adapted to reproduce relatively low-frequency audio sounds at an adequate output level.

According to the present invention, a driver of the speaker includes a plurality of magnetic coils wound around a common bobbin. Each of the magnetic coils is connected to a common amplifier to receive the same drive signal. By applying the common drive signal to each magnetic coil, the electromagnetic force created by the driver is increased approximately in proportion to the number of the magnetic coils. Due to this increased electromagnetic force, a vehicle panel serving as a sound-amplifying medium can be satisfactorily and successfully driven so as to produce high-quality sound.

Preferably, each of the magnetic coils is connected to an amplifier adapted to amplify the low-frequency component of the audio signal from a main amplifier.

According to one embodiment of the invention, an automotive audio system comprises means for producing an audio signal including a intermediate- and high-frequency component and a low-frequency component, means for amplifying the low-frequency component of the audio signal, a speaker system including a first speaker adapted to reproduce the intermediate- and high-frequency component of the audio signal and a second speaker adapted to reproduce the low-frequency component of the audio signal, a driver unit associated with the second speaker for driving a sound-amplifying medium in the second speaker to produce the low-frequency component of the audio signal, and a plurality of magnetic coils incorporated in the driver unit, each connected to the amplifying means to be energized by the low-frequency component of the audio signal.

According to another aspect of the invention, a speaker system applicable to an automotive audio system comprises a member having at least a section thereof free to oscillate to produce audio sounds, which member also forms a part of the vehicle independent from the audio system, an amplifier for amplifying audio signal components of a specific frequency range, a driver unit connected to the amplifier and positioned adjacent the oscillating section to drive the section for oscillation in the specific frequency range, and a plurality of magnetic coils incorporated in the driver unit, each connected to the amplifier to be energized by audio signal components of the specific frequency range.

In still another aspect of the invention a driver unit for a speaker in an automotive audio system including a member serving as a sound-amplifying medium and also constituting a part of vehicle independent from the audio system, comprising the assembly of a pole member, a yoke member and a magnet for generating a permanent magnetic field, a plurality of magnetic coils wound around a common bobbin secured to the member serving as the sound-amplifying medium, the magnetic coils being adapted to receive a common audio signal and to each be energized by the common audio signal.

BRIEF DESCRIPTION OF THE DRAWINGS

The present invention will be understood more fully from the detailed description given herebelow and from the accompanying drawings of the preferred embodiment of the present invention, which, however, should not be taken as limitative to the invention but for elucidation and explanation only.

In the drawings.

DESCRIPTION OF THE PREFERRED EMBODIMENTS

Figure 1:
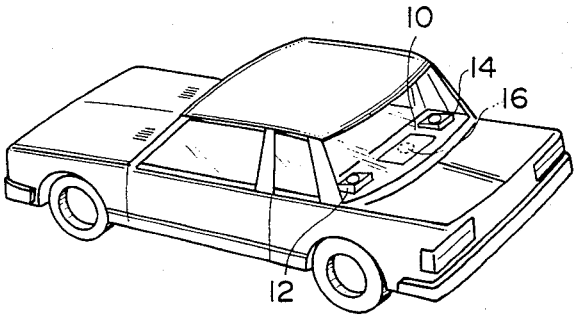
FIG. 1 is a perspective view of an automotive vehicle having a speaker system according to the present invention.

Referring now to FIG. 1, a vehicular speaker system is mounted on the rear parcel shelf 10 of the vehicle.

The speaker system comprises a pair of cone-speakers 12 and 14 and a speaker 16 utilizing part of the rear parcel shelf to amplify the audio sound according to the preferred embodiment. The cone-speakers 12 and 14 are adapted to reproduce intermediate- and high-frequency audio sounds and the speaker 16 is adapted to reproduce low-frequency sounds.

The speakers 12, 14 and 16 are associated with an automotive audio system which is not shown in FIG. 1 and receive corresponding frequency components of the audio signal for reproduction while the audio system is in operation.

Figure 2:
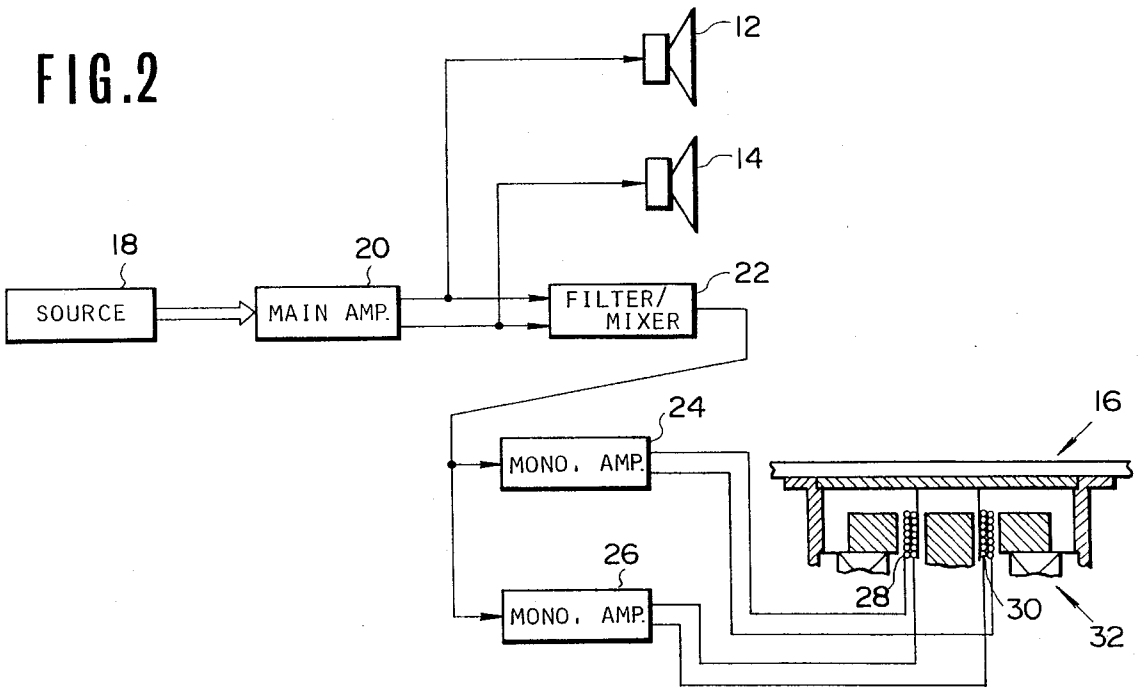
FIG. 2 is a schematic block diagram of an automotive audio system.

As shown in FIG. 2, the audio system includes an audio signal source 18 such as radio tuner, cassette-deck and so forth. The audio signal source 18 is connected to a main amplifier 20. The main amplifier 20 receives the audio signal from the audio signal source 18 to produce a left-side amplifier output signal and a right-side amplifier output signal. The intermediate- and high-frequency components of the left-side amplifier output signal are conducted to the left-side cone-speaker 12 and the intermediate- and high-frequency components of the right-side amplifier output signal are conducted to the right-side cone-speaker 14 for stereo reproduction of the audio sound. At the same time, the low-frequency components of both of the left-side and right-side amplifier output signals are fed to a filter/mixer circuit 22. The filter/mixer circuit 22 produces a low-frequency monaural signal from the low-frequency components of the left-side and right-side amplifier output signals which is then sent to monaural amplifiers 24 and 26. The monaural amplifiers 24 and 26 are respectively connected to magnetic coils 28 and 30 in a driver unit 32 of the speaker 16.

Figure 3:
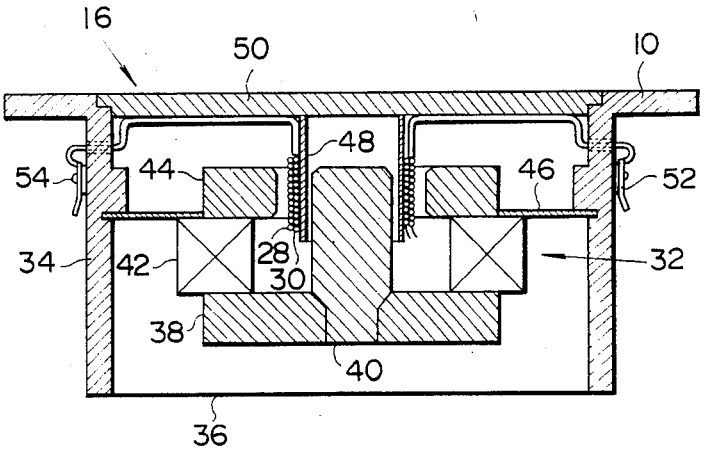
FIG. 3 is an enlarged cross-section of the preferred embodiment of a speaker according to the present invention.

As shown in FIG. 3, the driver unit 32 is received in a housing 34 with a back cover 36 and comprises a yoke plate 38 with a central pole piece 40 projecting therefrom, an annular magnet 42 surrounding the pole piece, and an annular yoke 44 also surrounding the pole piece. The assembly of the yoke plate 38, the pole piece 40, the magnet 42, and the annular yoke 44 is supported by the housing by way of a supporting damper 46 made of a resilient material so as to be free to oscillate vertically. In addition, a cylindrical bobbin 48 is secured to the part 50 of the rear parcel shelf 10 serving as the sound-amplifying medium and disposed between the pole piece 40 and both the annular yoke 44 and the magnet 42 so as to surround the cylindrical surface of the pole piece. The inner and outer magnetic coils 28 and 30 are wound concentrically around the bobbin 48. The magnetic coils 28 and 30 fall within the magnetic field defined by the yoke plate 38, the magnet 42 and the pole piece 40. The magnetic coils 28 and 30 are connected to the monaural amplifiers 24 and 26 via input terminals 52 and 54, respectively.

During operation of the audio system as set forth, the audio signal from the audio signal source is fed to the cone-speakers 12 and 14 as left-side and right-side amplifier output signals respectively via the main amplifier 20. The cone-speakers 12 and 14 perform stereo sound reproduction for the intermediate- and high-frequency components of the audio signal. The low-frequency components of the left-side and right-side amplifier output signals pass through the filter in the filter/mixer circuit 22 and are combined by the mixer thereof to be output as a monaural signal. The monaural signal from the filter/mixer circuit 22 is fed to the monaural amplifiers 24 and 26 to be amplified. The monaural amplifiers 24 and 26 have identical amplifier characteristics so as to produce substantially identical monaural amplifier outputs. Therefore, the magnetic coils 28 and 30 are synchronously energized by identical monaural amplifier outputs. As a result, two separate but identical magnetic fields are formed around the pole piece 40 by energization of the magnetic coils 28 and 30. The magnetic fields created by the magnetic coils 28 and 30 when energized constructively interfere to increase the driving power.

Therefore, the oscillating section 50 of the rear parcel shelf 10 is driven with adequate driving power to improve the quality of the low-frequency components of audio sound and thus improve the overall sound reproduction quality.

It should be appreciated that, while a specific embodiment of the present invention has been disclosed hereabove for detailed explanation of the invention, the invention can be embodied otherwise or modified in any way without departing from the principle thereof. For example, number of the magnetic coils can be changed as needed and the monaural amplifiers can be replaced by a single stereo amplifier. Furthermore, while a specific speaker system has been disclosed hereabove, the arrangement of the speaker system can be changed in various way.

What is claimed is:

1. An automotive audio system comprising;

means for producing an audio signal;

means for amplifying a given specific frequency range of the audio signal, said amplifying means including a plurality of amplifiers adapted to amplify the specific frequency range of audio signals;

a speaker system including a speaker for reproducing said specific frequency range of the audio signal;

a driver unit associated with said speaker for driving a sound-amplifying medium in said speaker to reproduce said specific frequency range of the audio signal; and a plurality of magnetic coils incorporated in said driver unit, each of said magnetic coils being connected to a corresponding different one of the amplifiers of said amplifying means to be energized by said specific frequency range of the audio signal in unison.

2. An automotive audio system comprising;

means for producing an audio signal including an intermediate- and high-frequency component and a low-frequency component;

means for amplifying the low-frequency component of the audio signal, said amplifying means including at least two monaural amplifiers which amplify the low-frequency component in unison;

a speaker system including a first speaker connected to said audio signal producing means to receive said audio signal for reproducing the intermediate- and high-frequency component of the audio signal and a second speaker for reproducing the low-frequency component of the audio sound;

a driver unit associated with said second speaker for driving a sound-amplifying medium in said second speaker to reproduce said low-frequency component of the audio signal; and a plurality of magnetic coils incorporated in said driver unit, each connected to a corresponding different amplifier of said amplifying means to be energized by said low-frequency component of the audio signal in synchronism with other magnetic coils.

3. An automatic audio system comprising;

means for producing an audio signal;

means for amplifying a given specific frequency range of the audio signal, and having at least two monaural amplifiers respectively connected to said audio signal producing means to receive said specific frequency range of the audio signal therefrom;

a speaker system including a speaker for reproducing said specific frequency range of the audio signal, said speaker including a vehicle panel forming a part of a vehicle body and being sufficiently flexible to oscillate at an audio frequency, said vehicle panel comprising at least a section adapted to oscillate for producing an audio sound;

a driver unit, associated with said speaker for driving said vehicle panel to reproduce said specific frequency range of the audio signal; and a plurality of magnetic coils incorporated in said driver unit, each connected to a different one of the corresponding amplifiers of said amplifying means to be energized by said specific frequency range of the audio signal in unison.

4. An automotive audio system comprising:

means for producing an audio signal including an intermediate- and high-frequency component and a low-frequency component;

means for amplifying the low frequency component of the audio signal, said amplifying means having a plurality of monaural amplifiers adapted to amplify the low frequency component in unison to each other;

a speaker system including a first speaker connected to said audio signal producing means to receive said audio signal therefrom for reproducing the intermediate- and high-frequency component of the audio signal and a second speaker for reproducing the low-frequency component of the audio signal, said second speaker having a vehicle panel forming a part of a vehicle body and being sufficiently flexible to oscillate at an audio frequency, said vehicle panel comprising at least a section adapted to oscillate for producing an audio sound;

a driver unit, associated with said second speaker for driving said vehicle panel in said speaker to reproduce the low-frequency component of the audio signal; and a plurality of magnetic coils incorporated in said driver unit, each connected to a corresponding different one of said amplifiers to be energized by said low-frequency component of the audio signal, and said magnetic coils cooperating with each other to amplify the amplitude of oscillation of said vehicle panel.

5. A speaker system applicable for an automotive audio system comprising;

a vehicle panel forming a part of a vehicle body and being sufficiently flexible to oscillate at an audio frequency, said vehicle panel comprising at least a section adapted to oscillate for producing an audio sound;

a driver unit connected to an audio unit producing an audio signal and positioned adjacent said section to drive said section for oscillation in said specific frequency range and comprising a housing secured to said section of said vehicle panel, a driver assembly resiliently suspended within said housing, and a plurality of magnetic coils, each connected to a different one of a plurality of amplifiers in said audio unit to be energized by a specific frequency range of the audio signal in synchronism with each other.

6. A driver unit for a speaker in an automotive audio system comprising:

a vehicle panel facing a vehicle compartment and having a section adapted for oscillation at an audio frequency to produce an audible sound;

an assembly of a pole member, a yoke member and a magnet generating a permanent magnetic field;

a plurality of magnetic coils wound around a common bobbin secured to said vehicle panel and connected to an audio unit including a plurality of amplifiers, each of said magnetic coils receiving a common audio signal from a different one of the plurality of corresponding different amplifiers and being energized by said common audio signal in unison.

7. A driver unit for a speaker in an automotive audio system including:

a vehicle panel facing a vehicle compartment and having a section adapted for oscillation at an audio frequency to produce an audible sound;

a housing secured to said section of said vehicle panel;

an assembly resiliently suspended within said housing and including a pole member, a yoke member and a magnet generating a permanent magnetic field;

a plurality of magnetic coils wound around a common bobbin secured to said vehicle panel and connected to an audio unit including a plurality of amplifiers, each of said magnetic coils receiving a specific frequency range of a common audio signal from a different one of the plurality of amplifiers and being energized by said common audio signal in unison.

8. A driver unit for a bass speaker in an automotive audio system comprising:

a vehicle panel forming a part of a vehicle body and being sufficiently flexible to oscillate at an audio frequency, said vehicle panel comprising at least a section adapted to oscillate for producing an audio sound;

a driver housing rigidly secured to said vehicle panel;

an assembly resiliently suspended to said section of the vehicle panel and including a pole member, a yoke member and a magnet generating a permanent magnetic field;

at least two magnetic coils wound around a common bobbin secured to said section of the vehicle panel, each of said magnetic coils connected to a corresponding different one of at least two amplifiers of an audio unit and receiving a relatively low-frequency component of a common audio signal therefrom, said magnetic coils being energized by the low-frequency components of said common audio signal in synchronism to each other.

* * * * *